US005094586A

United States Patent [19]

Takada et al.

[11] Patent Number: 5,094,586

[45] Date of Patent: Mar. 10, 1992

[54] AIR CONDITIONER EMPLOYING CROSS-FLOW FAN

[75] Inventors: Yoshiro Takada, Tsuchiura, all of; Shinya Yoshinaga, Tochigi; Atsushi Ootsuka, Tochigi; Youji Sekine, Tochigi; Hajime Fujita, Ibaraki, all of Japan

[73] Assignee: Hitachi, Ltd., Tokyo, Japan

[21] Appl. No.: 542,004

[22] Filed: Jun. 22, 1990

[30] Foreign Application Priority Data

Jun. 23, 1989 [JP] Japan ..... 1-159574

[51] Int. Cl.[5] ..... F04D 5/00; F04D 29/00

[52] U.S. Cl. ..... 415/53.3; 415/119

[58] Field of Search ..... 415/53.1, 52.1, 53.3, 415/119

[56] References Cited

U.S. PATENT DOCUMENTS

| | | | |
|---|---|---|---|
| 1,823,579 | 9/1930 | Anderson | 415/53.1 |
| 3,178,100 | 4/1965 | Dätwyler | 415/53.1 |
| 3,695,775 | 10/1972 | Zenkner | 415/53.1 |
| 4,014,625 | 3/1977 | Yamamoto | 415/53.1 |
| 4,174,020 | 11/1979 | Challis | 415/119 |
| 4,279,569 | 7/1981 | Harloff | 415/53.3 |
| 4,913,622 | 4/1990 | Tanaka et al. | 415/53.1 |

FOREIGN PATENT DOCUMENTS

| | | |
|---|---|---|
| 130149 | 12/1970 | Japan . |
| 5908 | 1/1975 | Japan . |
| 115408 | 9/1977 | Japan . |

*Primary Examiner*—Edward K. Look
*Assistant Examiner*—Michael S. Lee
*Attorney, Agent, or Firm*—Antonelli, Teery, Stout & Kraus

[57] ABSTRACT

An air blower for an air conditioning unit or system including a cross-flow fan, with stabilizer being mounted in a passage on a suction side of the cross-flow fan so as to extend from both side plates of the cross-flow fan toward a central part thereof within a range of $L/D \leqq 2.5$, where L equals the length of each of the stabilizers and D equals the outside diameter of the cylindrical bladed rotor of the cross-flow fan. By virtue of such an arrangement the back flow developing at positions of low flow velocities near both side plates when the flowing resistance of the suction passage has increased is prevented thereby preventing the occurrence of cyclic unsteady noise.

12 Claims, 11 Drawing Sheets

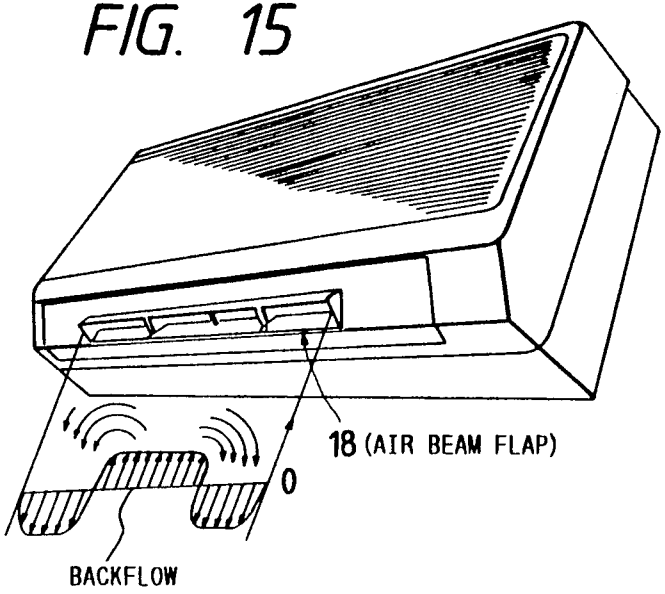
FIG. 15
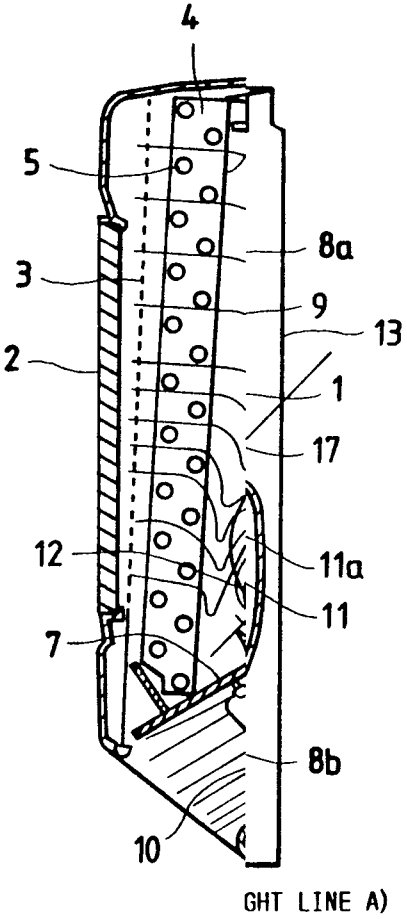
FIG

AIR CONDITIONER EMPLOYING CROSS-FLOW FAN

BACKGROUND OF THE INVENTION

The present invention relates to air conditioners, air cleaners, air curtains, employing a cross-flow fan as a blowing mechanism and, more particularly, to a blowing mechanism with a low noise level even when a clogged filter increases a flow resistance on an air suction side.

In air conditioning equipment plants employing cross-flow fans, to suppress the increase of noise attributable to a back flow which develops when the flow resistance of the air has increased due to a clogged filter, in, for example, Japanese Patent Publication 21162/1975, a back flow preventing mechanism locally extends from each side end face of the cross flow fan to a central part thereof in a discharge space.

Additionally, in Japanese Patent Laid-Open 5903/1975 and 115408/1977, an apparatus is provided which is furnished with guide vanes forcibly deflecting the streams of air from a heat exchanger to a cylindrical bladed rotor of the cross-flow fan in a suction side space to thereby increase the flow rate of the air.

It is desirable to reduce the noise level in air conditioning equipment and plants; however, in air conditioning equipment and plants employing a cross-flow fan, vortices, peculiar to the cross-flow fan exist, so that a discharge passage has, in effect, a cross sectional area thereof reduced thereby resulting in the problem that the flow velocity of air passing through the vanes to the cross-flow fan in the discharge section raises the level of noise generated.

A method for solving this problem is such that the spread angle of a casing which is formed into a helical shape is widened so as to expand the discharge passage and to lower the flow velocity, whereby the noise level is lowered. In the case of adopting the spread casing, however, the position of the vortex near a side plate at each end face of the cylindrical bladed rotor of the cross-flow fan becomes very unstable, and the backflow is liable to develop, particularly when the fluid resistance has increased due to, for example, the adhesion of dust to the filter disposed on the air suction side or the installation of an air cleaning filter. When the backflow has developed at one end face of the cylindrical bladed, another backflow develops also at the other end face with a difference in time. A cyclic backflow phenomenon in which the developments of the backflow recur, arises continuously. The resulting unsteady sound raise the problem that, when the fluid resistance of the suction passage has increased, any of the silent air-conditioning equipment and plants cannot be provided.

With the apparatus proposed in the aforementioned Japanese Patent Publication No. 21162/1975 problems arise in that, when the spread angle of the casing is widened, the backflow preventive effect of the apparatus is lost, so the unsteady sound develops, and, since the discharge passage has its cross-sectional area reduced, the specific characteristic of the cross-flow fan is sacrificed, and the rotational speed of the fan is inevitably increased for increasing the flow rate, so the level of noise rises.

The apparatus disclosed in the aforementioned Japanese Patent Laid-Open No. 5908/1975 or No. 115408/1977 is such that the guide vane is mounted in the suction side space, and that the air streams from the heat exchanger to the cylindrical bladed rotor of the cross-flow fan are forcibly deflected by the vane, to thereby increase the flow rate. However, the forcible deflection, results in the problems of the streams becoming turbulent behind the guide vane flow into the fan blades, so a turbulent flow noise increases, and blade passing noise also increases. Thus, it has been impossible to provide an apparatus with a means for effectively reducing a level noise generated.

SUMMARY OF THE INVENTION

The first object of the present invention is to provide, in an air blower, an air conditioner or the like wherein a cross-flow fan is employed for a blowing mechanism, an air blower, an air conditioner or the like which is silenced by preventing the phenomenon peculiar to the cross-flow fan that a vortex position becomes unstable to cyclically repeat backflow, even when the spread angle of a casing is widened.

The second object of the present invention is to provide, in an air conditioner or the like wherein a cross-flow fan is employed for a blowing mechanism, an air conditioner or the like which is silent even when an air cleaning element or the like is mounted on the whole surface of a suction side. p In order to accomplish the above objects of the present invention, stabilizers are mounted so as to protrude from both the side plates of the cross-flow fan toward the central part thereof in the suction side passage of this fan, within a range of $L/D \leqq 2.5$ (where L denotes the length of each stabilizer, and D denotes the outside diameter of the cylindrical bladed rotor of the cross-flow fan) within which the distribution of flow velocities changes from zero to a uniform value.

The stabilizers are mounted within the aforementioned range of $L/D \leqq 2.5$, and they are arranged so that their extension lines may lie between the axis of the cylindrical bladed rotor and the center of a vortex induced by the cross-flow fan.

The stabilizers are mounted within the aforementioned range of $L/D \leqq 2.5$, and subject to a casing spread angle of $\alpha \geqq 16°$, a clearance ratio $\delta/D$ is set at $\delta/D \leqq 0.2$, where $\delta$ denotes the clearance between a tongue and the cylindrical bladed rotor having the outside diameter D.

Notches are formed in the trailing edge of each of the stabilizers.

A back nose separating the suction passage and discharge passage of the cross-flow fan is provided on the suction passage side with respect to a line which connects the suction side end of the tongue and the axis of the cylindrical bladed rotor.

The back nose is mounted on the suction passage side with its highest position defining an angle of 20°-50° with respect to the line which connects the suction side end of the tongue and the axis of the cylindrical bladed rotor.

A sound absorbing material is mounted on that part of the back nose which confronts the cylindrical bladed rotor, or the back nose is constructed into a resonance type silencer structure.

Some or all of a plurality of deflectors provided on the discharge side are thickened toward down streams, or a passage spread toward the down streams is formed.

BRIEF DESCRIPTION OF THE DRAWINGS

FIG. 14 is a vertical cross sectional view of a further embodiment of the present invention;

FIG. 15 is an exterior perspective view of a room air conditioner;

DETAILED DESCRIPTION OF THE PREFERRED EMBODIMENTS

Figure 2:
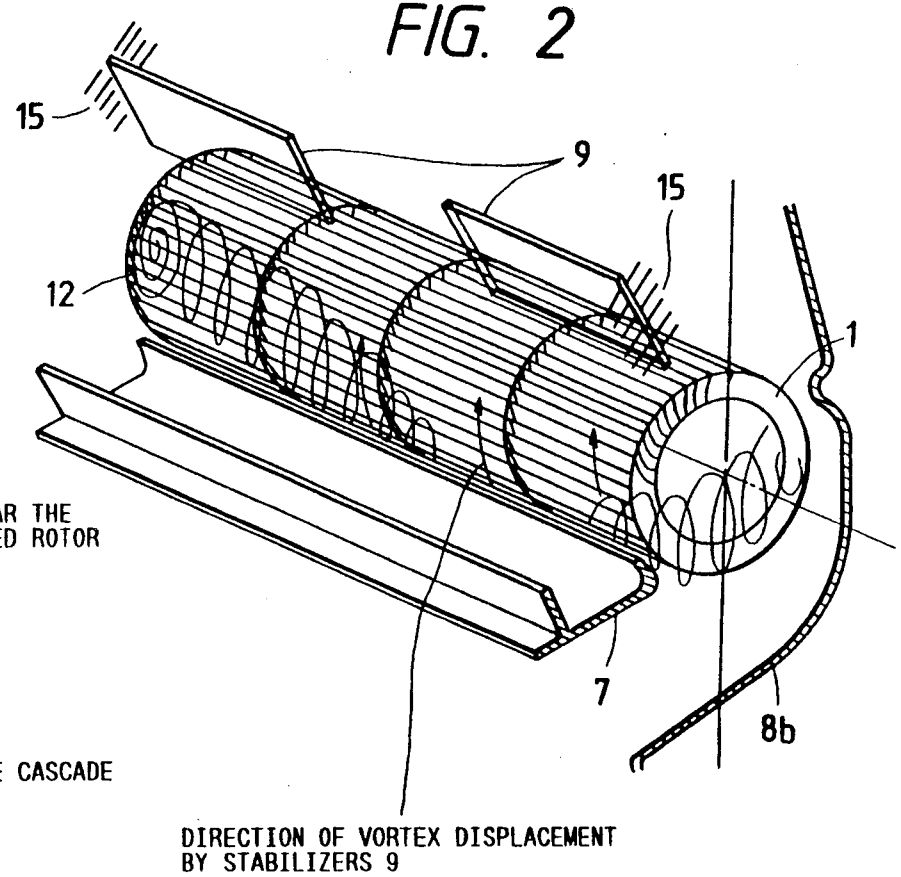
FIG. 2 is a perspective view of the embodiment of FIG. 1.
Figure 1:
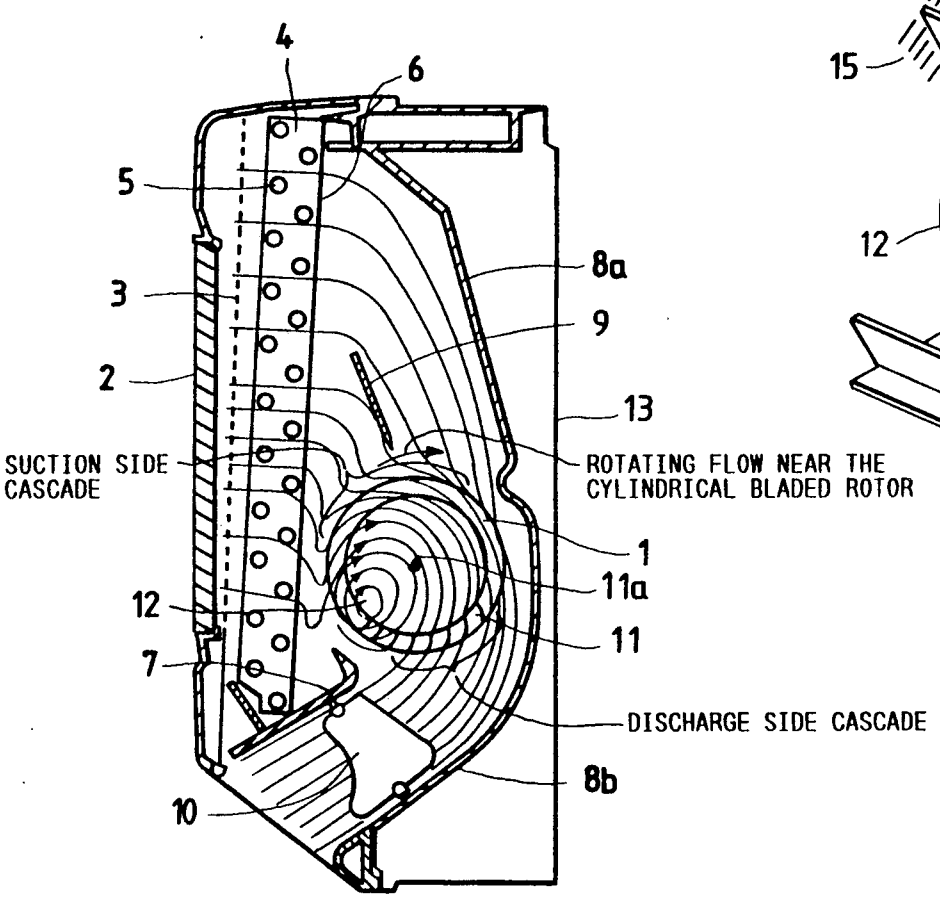
FIG. 1 is a vertical cross sectional view of a first embodiment of the present invention.
Figure 3:
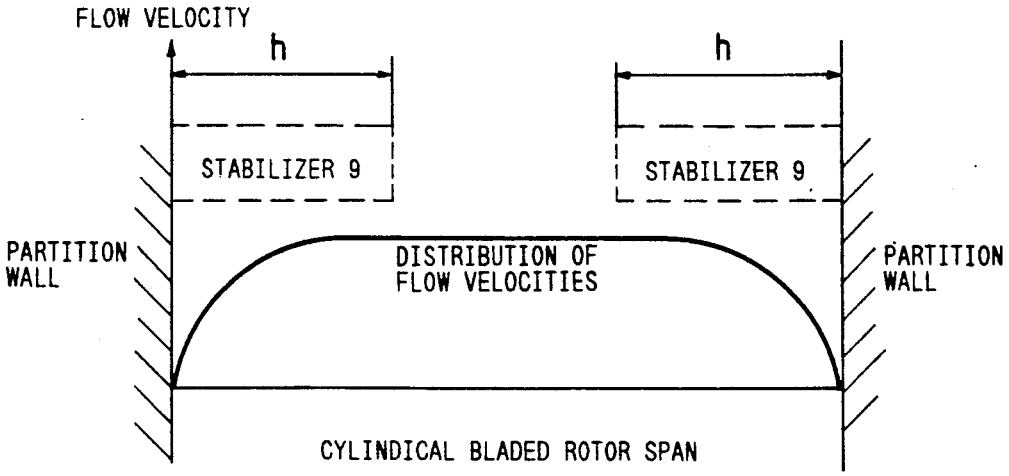
FIG. 3 is a graphical illustration depicting the distribution of flow velocities along a cross-flow fan.

FIGS. 1 and 2 illustrate a case where the present invention is applied to the indoor unit of a room air conditioner. The indoor unit of the room air conditioner includes a casing 8, accommodating a grille 2, a filter 3, a heat exchanger 4, piping 5 forming part of the heat exchanger 4, a radiation fin 6, a tongue 7 for collecting drain, stabilizers 9, a deflector 10, a cross-flow fan 11, a unit chassis 13, and side plates 15. A fluid, namely, air, drawn from the grille 2 by suction, is passed through the filter 3 as well as the heat exchanger 4, and it is endowed with a momentum by the cross-flow fan 11 which lies between the tongue 7 and the casing 8 and which is rotated. The air is subjected to a wind direction control by the deflector 10, and is blown out from the lower part of the casing 8. A passage on the suction side is formed of either a passage whose cross-sectional area is equal to the cross-flow fan 11, or a passage of the so-called speed-up type having a gradually decreasing cross-sectional area. The stabilizer 9 is mounted within the suction passage enclosed with the heat exchanger 4 and the suction casing 8*a* of the casing 8 as shown in FIGS. 1 and 2, and it the stabilizer 9 has a height h from the corresponding side plate 15 at the end face of the cross-flow fan 11 toward the central part of this fan as shown in FIG. 3.

A plurality of such stabilizers may well be arranged on each side of the cross-flow fan 11, and each stabilizer may be in the shape of any of a thin rectangular plate, a wing, a sector, etc.

The cross-flow fan 11 blows the air in such a way that cylindrical bladed rotor 1 is rotated round the axis 11*a* of the fan. Therefore, a vortex peculiar to the cross-flow fan 11 are generated around a vortex center 12 as shown in FIG. 1. In the absence of the stabilizers 9, the intensity of the vortex is lower near both the side plates 15 at the end faces of the cross-flow fan 11 than at the central part of this fan. Accordingly, when fluid losses are increased slightly on the suction passage side, for example, when the filter 3 becomes clogged due to dust, a backflow occurs in which the fluid on the side of a discharge passage flows into the suction passage side of lower pressure. This is attributable to the fact that, since partition walls exist, the circulating flow velocity of the air lowers near the side plates 15 resulting in a stagnation between the tongue 7 and the cross-flow fan 11, so the backflow fails to be prevented due to the stagnation. As a result, a pressure balance in the span direction of the cross-flow fan 11 is lost, the pressure on one side near the side plate temporarily rises, the position of the vortex fluctuates circumferencially of the cross-flow fan 11, and the fluctuation propagates in the span direction of the cross-flow fan 11. Since this phenomenon cyclically occurs in alternating fashion, unsteady noise develops continuously. In case of widening the spread angle of the casing 8, that is, in case of widening the angle at which the casing 8 spreads toward the down stream of the air with reference to the outside diameter of the cross-flow fan 11, the phenomenon takes place especially conspicuously because the vortex position becomes unstable and fluctuates more in that case.

Figure 4:
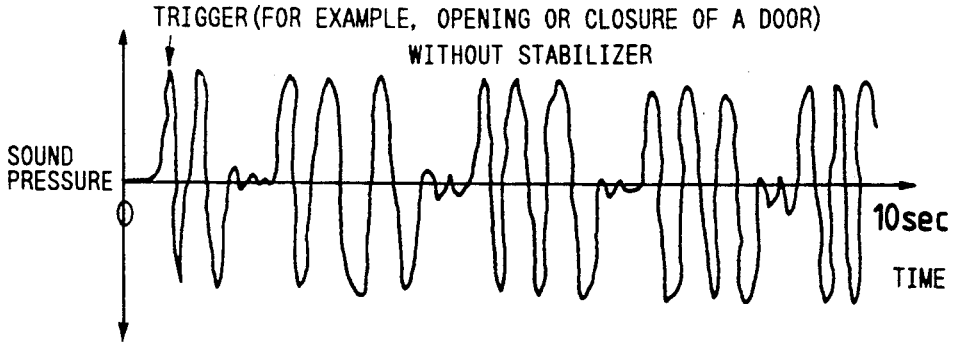
FIGS. 4 and 5 are graphical illustrations explaining the effect of the present invention based on experiments.
Figure 5:
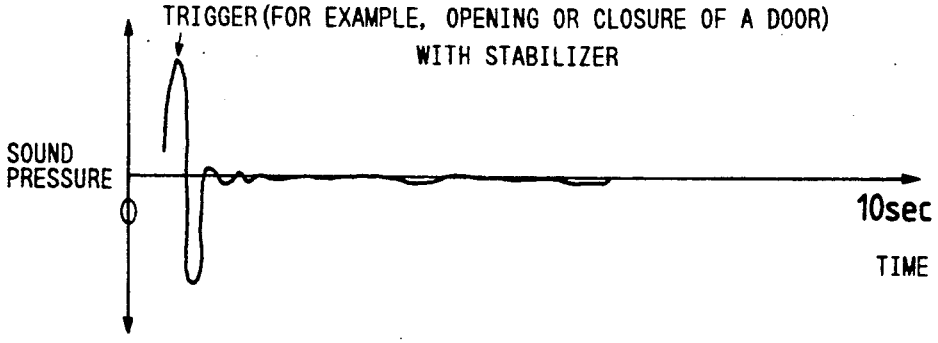

As stated before, each stabilizer 9 extends over a height h from the corresponding side plate 15 toward the central part of the cross-flow fan 11. This height h is determined as described below. FIG. 3 is a diagram showing the distribution of flow velocities on the suction side. The flow velocity distribution of the air on the suction side is a bilaterally symmetric distribution wherein the flow velocity is nil on each side plate 15 and wherein it increases toward the central part of the cross-flow fan 11 and becomes a constant value. The backflow is liable to develop at the part of low flow velocity as described earlier, and the stabilizer 9 is effective when extended up to a position at which the flow velocity distribution becomes uniform. As illustrated in FIGS. 4 and 5, it has been experimentally determined that, with dimensions of $L/D \leqq 2.5$, where L denotes the length (the height h) of the stabilizer 9 and where D denotes the outside diameter of the cylindrical bladed rotor 1 of the cross-flow fan 11, the unsteady noise can be reliably prevented even when the flowing resistance of the suction side is high. The stabilizer 9 does not forcibly deflect suction streams, but is functions to stabilize the vortex position near the side plate 15. Therefore, it may cover only the part in which the velocity distribution of the suction streams is not uniform. It is rather unfavorable in point of noise to extend the stabilizer 9 beyond the position at which the flow velocity distribution becomes uniform, for the reason that blade passing noise develop when the air flows from the stabilizer 9 into the vanes of the cross-flow fan 11.

FIGS. 4 and 5 illustrate the difference between the durations of the cyclic unsteady noise in the cases where the stabilizers 9 and mounted and where they are not mounted. As shown in FIGS. 4 and 5, when the unsteady noise triggered by, for example, the opening or closing of a door, the cyclic, unsteady noise continues in the absence of the stabilizers 9 of the present invention, whereas, the unsteady raise immediately stops with the stabilizers 9 in the present invention.

As thus far described, by attaching the stabilizers 9, the vortex positions can be stabilized, and a silent room air conditioner is provided with no unsteady noise even when the filter 3 is clogged. Although this embodiment has has been described in connection with a room air conditioner, the present invention is also applicable to other air conditioners, air cleaners, air curtains, etc.

Figure 7:
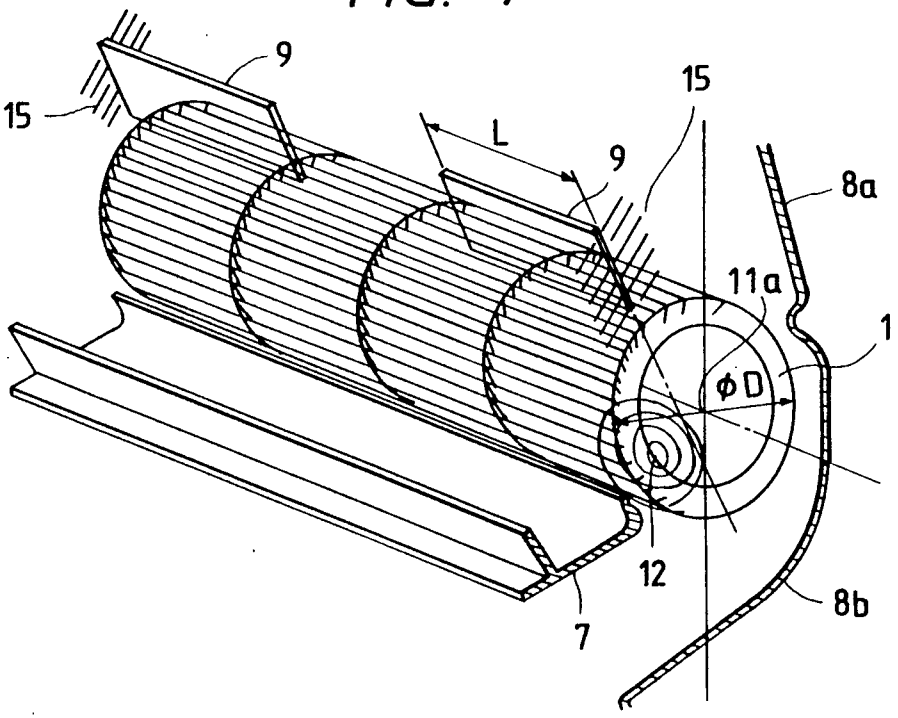
FIG. 7 is a perspective view of the embodiment of FIG. 6.
Figure 6:
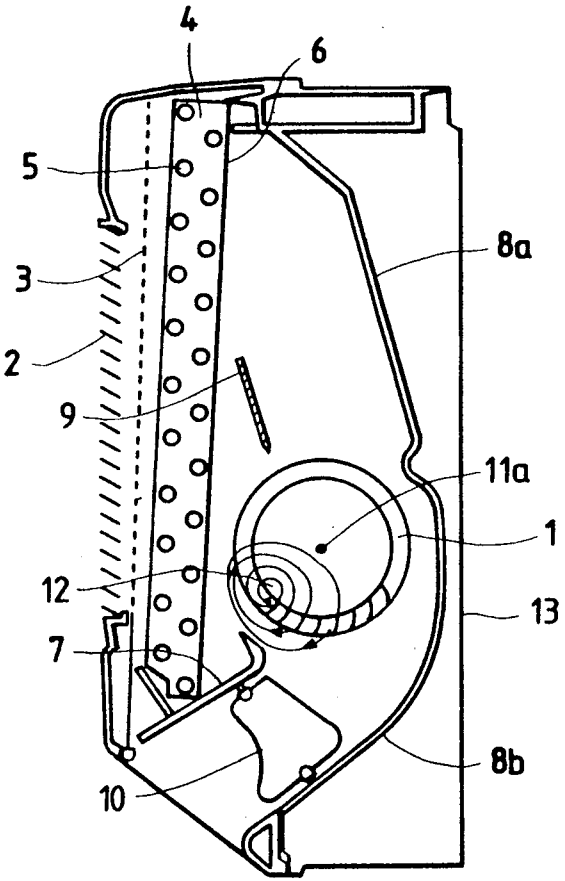
FIG. 6 is a vertical cross sectional view of another embodiment of the present invention.

The embodiment of FIGS. 6 and 7 particularly features the set positions of stabilizers 9. It is the same as in the embodiment shown in FIGS. 1 thru 3 in that the stabilizers 9 project from both the end faces of a cross-flow fan 11 corresponding to side plates 15, toward the central part of this fan. However, each stabilizer 9 is set so as to be directed toward the position between the axis 11*a* of the cross-flow fan 11 and a vortex center 12. Thus, the flow of air along the stabilizer 9 extends along the directions of the blade of the cross-flow fan 11, and the air flows smoothly inside the blades. In any other direction, the wake of the stabilizer 9 broadens to conspicuously develop blade passing noise and to increase pressure drop.

Figure 8:
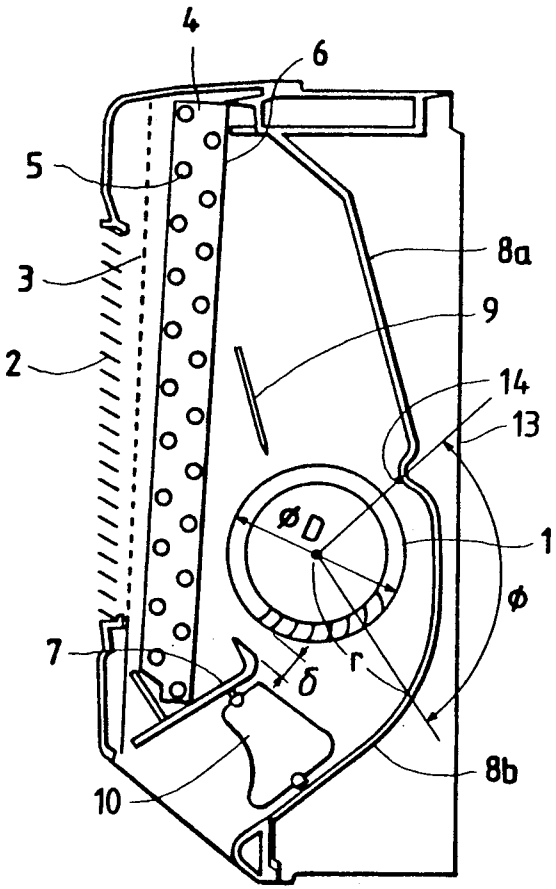
FIG. 8 is a vertical cross sectional view of yet another embodiment of the present invention.

In the embodiment of FIG. 8 the spread angle of a casing 8 in a discharge passage with the stabilizers 9 have an especially remarkable effect. The discharge passage usually has a helical casing shape, but the embodiment is also applicable to shapes similar thereto.

In FIG. 8, helix initiating position 18 of the casing 8, is a start point for forming the discharge passage. Letting $r_o$ denote the radius of a cylindrical bladed rotor 1, $\phi$ denote an angle defined to the helix initiating position 14, $\alpha$ denote the spread angle of the casing 8, and $\gamma$ denote a distance from the center of the cylindrical bladed rotor 1, the shape of the casing 8 is expressed by the following relationship:

$$\gamma = r_o \chi e^{\phi \cdot \tan\alpha}$$

It has been experimentally verified that the spread angle $\alpha$ at which the stabilizers 9 are especially effective is given by $\alpha \geqq 16°$, and that the ratio (termed "clearance ratio") $\delta/D$ of the clearance $\delta$ between the cylindrical bladed rotor 1 and a tongue 7 to the outside diameter D of the cylindrical bladed rotor 1 is given by $\delta/D \leqq 0.2$.

The stabilizers 9 of the present invention can prevent unsteady noise even in such a casing of wide spread angle, and the flow velocities of air on the discharge passage side lower, so that an air conditioner etc. which are silent can be provided.

Figure 9:
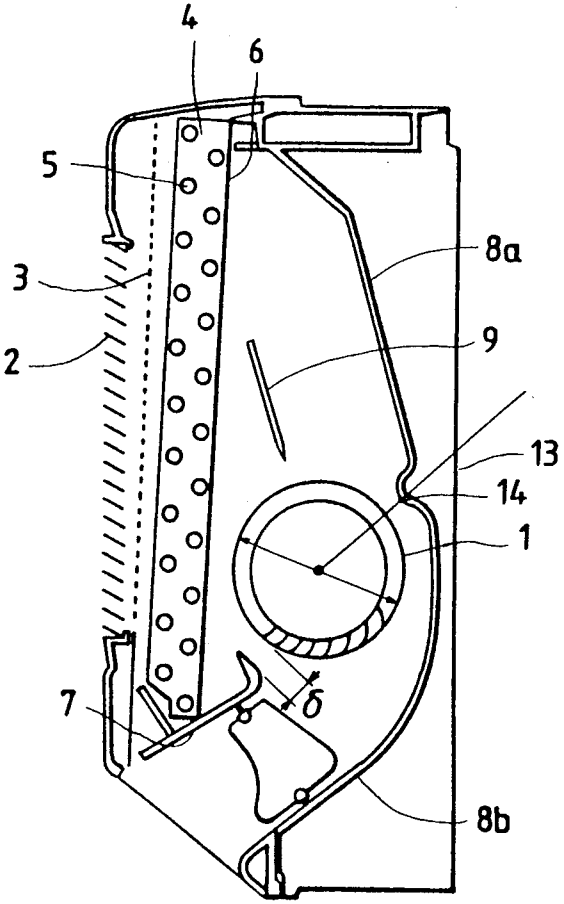
FIG. 9 is a vertical cross sectional view of a further embodiment of the present invention.
Figure 10:
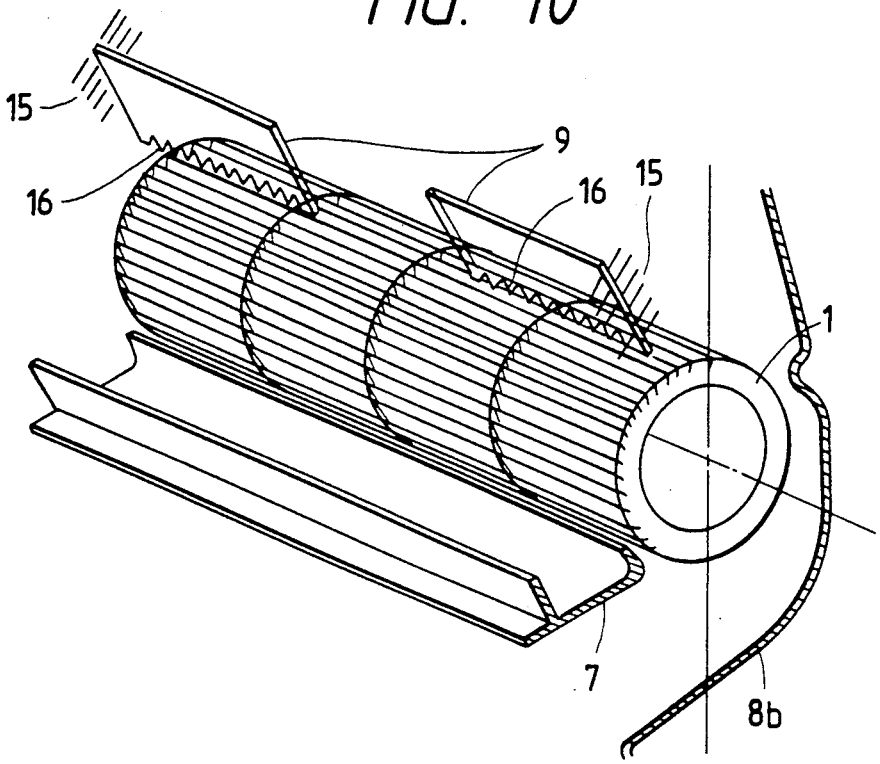
FIG. 10 is a perspective view of the embodiment of FIG. 9.

In the embodiment of FIGS. 9 and 10 triangular notches 16 are formed for the purpose of further lowering blade passing noise to break out near the trailing edge of stabilizers 9. The notches to be formed at the rear edges of the stabilizers 9 may well be in a corrugated shape, a square shape or any other shape, and they may well be inclined so that the trailing edges of the stabilizers 9 and the blades of a cylindrical bladed rotor 1 are not in phase in the span direction of a cross-flow fan 11. Thus, the blade passing noise can be effectively reduced.

The stabilizers 9 in each of the foregoing embodiments may well be unitarily preformed on at least one side of the unit chassis 13. It is also possible for one of the stabilizers 9 to be mounted on the side plate 15 by bonding, threaded engagement insertion or the like, while the other is mounted on a fixing plate provided on the inner surface of the suction side casing 8*a*, by threaded engagement, insertion, bonding or the like.

Figure 11:
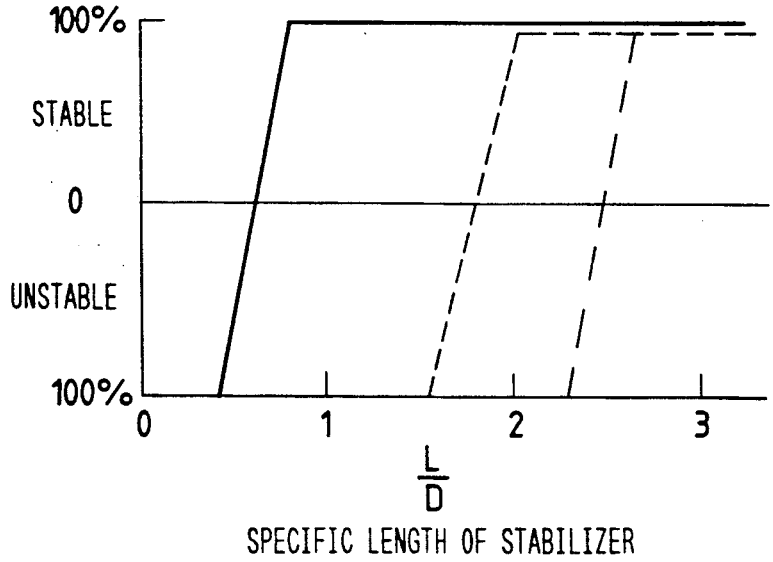
FIGS. 11 and 12 are graphical illustrations showing experimental results.
Figure 12:
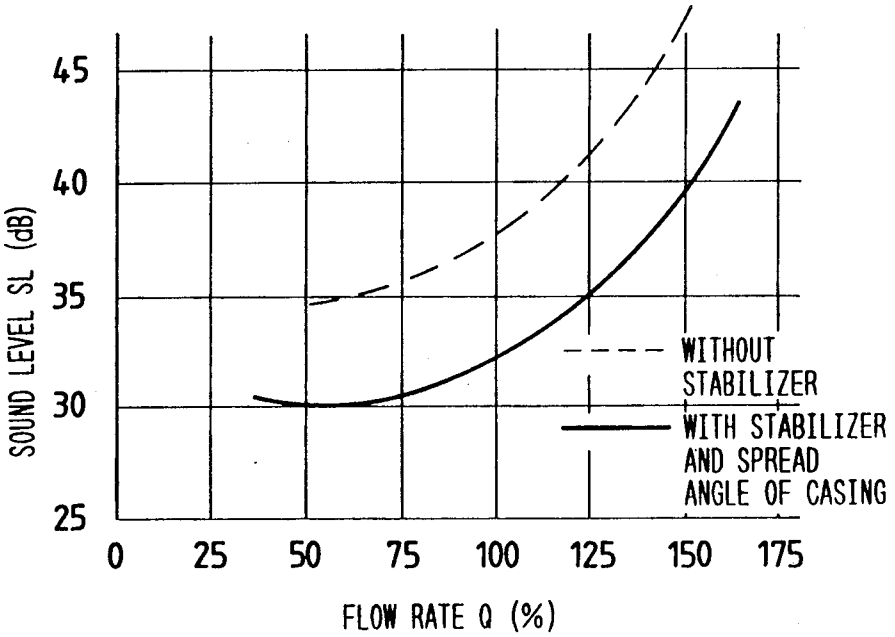

FIGS. 11 and 12 show experimental results in the case where the spread angle of the casing is wide. As shown in FIGS. 11 and 12 a low noise air conditioner is obtained according to the present invention.

Figure 13:
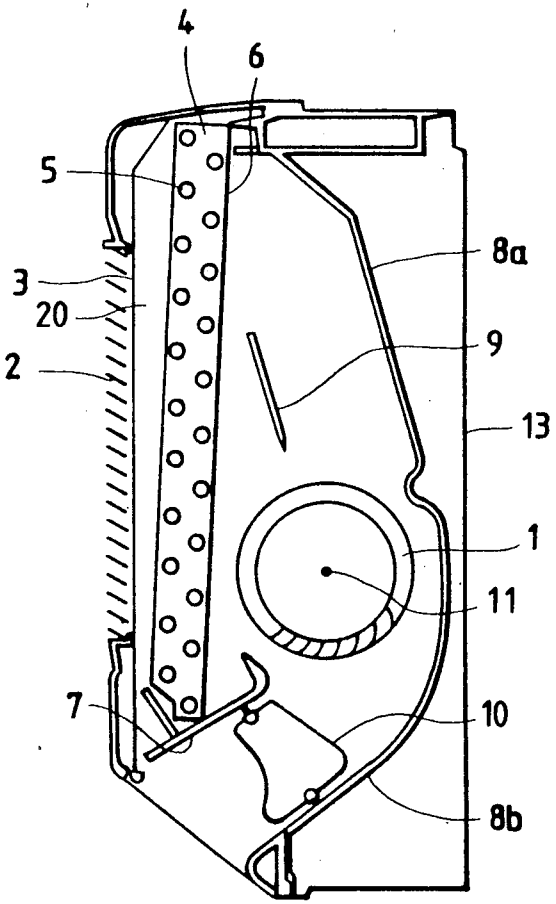
FIG. 13, is a vertical cross sectional view of a still further embodiment of the present invention.

The embodiment of FIG. 13 is similar to the embodiment shown in FIGS. 1 thru 3, however, an air cleaning element 20 is mounted so as to cover the surface of a suction side. When the air cleaning element covers the surface, the pressure drop of the suction side increases, and hence, the upsteady noise noted above generally arise. Since, however, the embodiment is furnished with stabilizers 9, it is effective to provide a silent air conditioner which blows clean air.

FIGS. 14 thru 23 respectively illustrate embodiments of the present invention which can prevent surging and can be operated without unsteady noise even in a case where a heat exchanger having a larger number of layers, or having a large pressure drop is employed for blowing out warmer wind and where a region of lower flow rate has been reached.

In a flow pattern shown in FIG. 14, surging is liable to occur at the two parts of streams which lie between a stabilizer 9 and a suction casing 8*a*, and a deceleration passage which extends from a cross-flow fan 11 to a deflector 10. A back nose 17 shown in FIG. 14 is a measure coping with the former part. Heretofore, such a back nose has been provided on a straight line A which connects the suction side tip of a tongue 7 and the axis 11*a* of the cylindrical bladed rotor 1 of the cross-flow fan 11. Therefore, the suction streams become streams which rotate in the same direction as the rotating direction of the cross-flow fan 11, namely, pre-swirling streams. There streams fail to match with the inlet angle of the blade 1 and flow separation occurs on the surfaces thereof. As a result, the position of a vortex becomes unstable to incur the surging. In order to avoid this disadvantage, according to the embodiment shown in FIG. 14, the position of the back nose 17 is set to lie on the side of a suction passage above the straight line A. Thus, the suction streams can be brought into the direction of the axis 11*a* of the cross-flow fan 11. Moreover, since the suction streams are accelerated, the back nose 17 functions to attenuate disturbances, for example, the opening or closing of a door and the angular change of the deflector 10. Accordingly, the surging can be prevented. As described above, the back nose 17 in this embodiment operates jointly with the stabilizers 9, to turn the streams along a unit wall substantially toward the axis 11*a* of the cylindrical bladed rotor 1, thereby making it possible to prevent the preswirling, the flow separation and the surging.

Besides, the streams are accelerated in a passage which extends from a heat exchanger 4 to the suction portion of the cylindrical bladed rotor 1, whereby the disturbances to be imposed on the air conditioner can be relieved to the accelerated extent. It is therefore possible to reduce the disturbances which form a necessary condition for the surging of the cross-flow fan 11 inherently having characteristics less immune against the disturbances, that is, flow rate—pressure characteristics rising rightwards. Thus, the vortex position can be more stabilized to prevent the surging.

Figure 16:
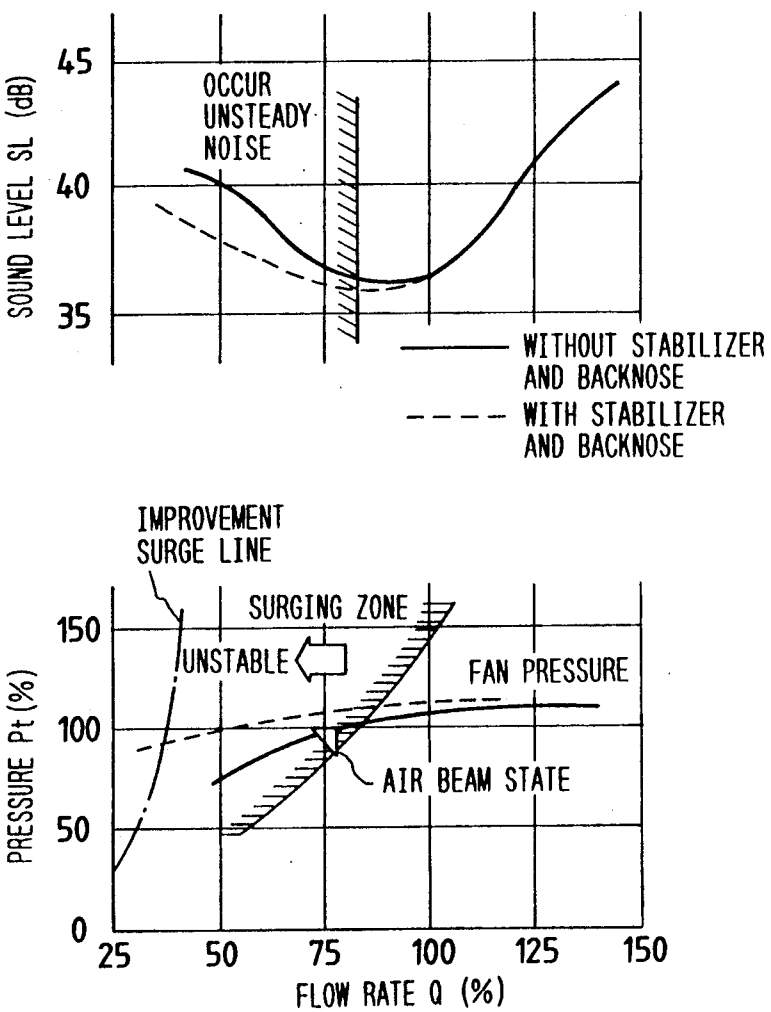
FIG. 16 is a graphical illustration explaining surging and the effect achieved by the embodiment of FIG. 14.

Such a back nose 17 is effective also for an air conditioner wherein the surging is prone to occur due to an increased pressure drops in a case where an air beam flap mechanism 18 shown in FIG. 15, which serves for spot air conditioning with throttled air streams and which forms a severe one of service conditions, is mounted and where the cross-flow fan is employed. FIG. 16 illustrates the characteristics of the cross-flow fan. As shown in FIG. 16, in the characteristics of the prior art, an air beam state is in a surging region, so that back flow and unsteady noise pose problems. In contrast, when the embodiment shown in FIG. 14 is applied, a pressure fall attributable to the pre-swirling can be prevented to enhance the characteristics and to lower the level of the noise, as indicated by broken lines. Additionally since a surge line is extended to a region indicated by a dot-and-dash line in FIG. 16, the surging can be prevented even in the air beam state and further in the clogged state of a filter 3.

Incidentally, sound pressure fluctuations during the surging proceed in the same situations as shown in FIGS. 4 and 5. More specifically, in the prior art, the continuous sound pressure fluctuation as shown in FIG. 4 occurs due to the trigger, for example, the change of the angle of the deflector, whereas, according to this embodiment, the surging ends in about 0.5–10 seconds as shown in FIG. 5.

Figure 17:
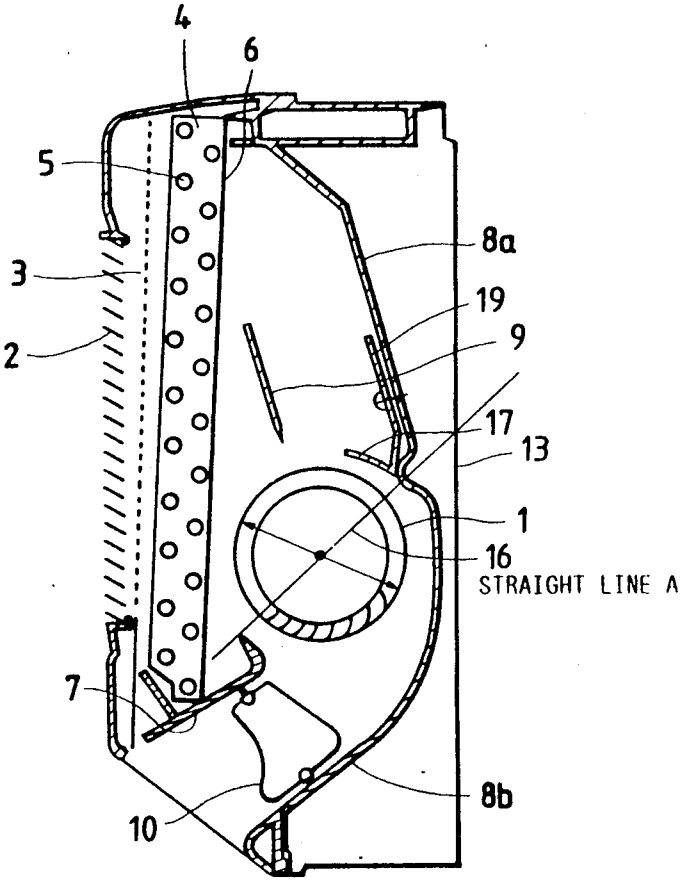
FIGS. 17–21 are vertical cross sectional views respectively showing other embodiments of the present invention.

In FIG. 17, the back nose 17 may be constructed in a smooth shape as shown in FIG. 14. In the embodiment shown in FIG. 17, however, the back nose 17 is made of a plate member, which is fixed to a suction casing 8*a* together with a stabilizing member 19 and the tip of which is located on a suction side above a straight line A. When such a construction is applied to an air conditioner or the like in which surging is problematic, it can prevent the surging.

Figure 18:
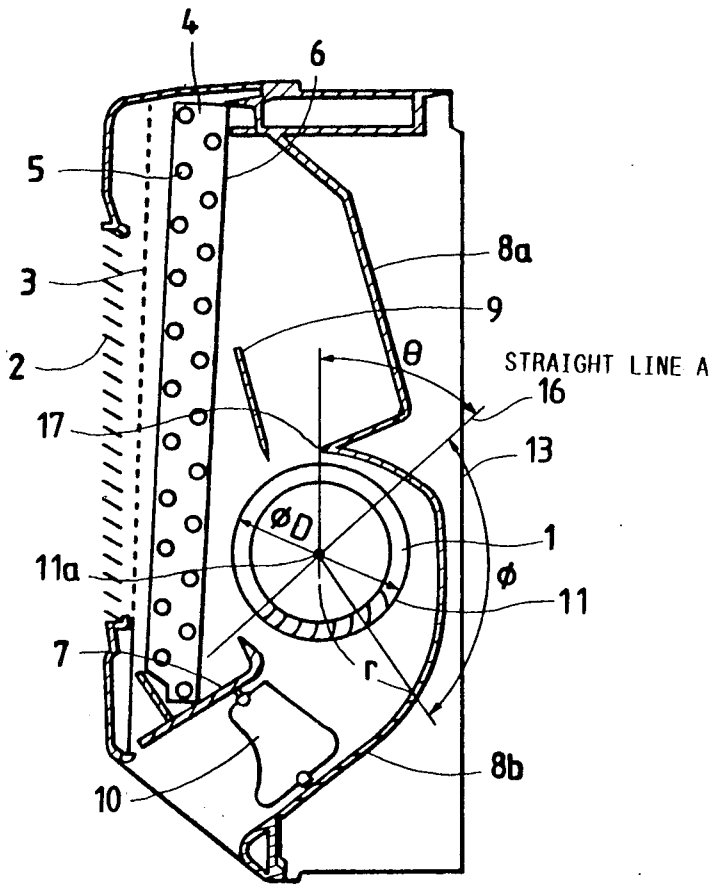

In the embodiment of FIG. 18 a back nose 17 is formed on a suction passage side above a straight line A, and the tip thereof is so located that a straight line connecting the axis 11*a* of a cross-flow fan 11 and the back nose tip defines an angle $\theta$ of 20°–50° with respect to the straight line A. By locating the back nose 17 at the aforementioned angle, stable streams free from surging can be created even when the rotational speed of the cross-flow fan 11 has lowered.

Figure 19:
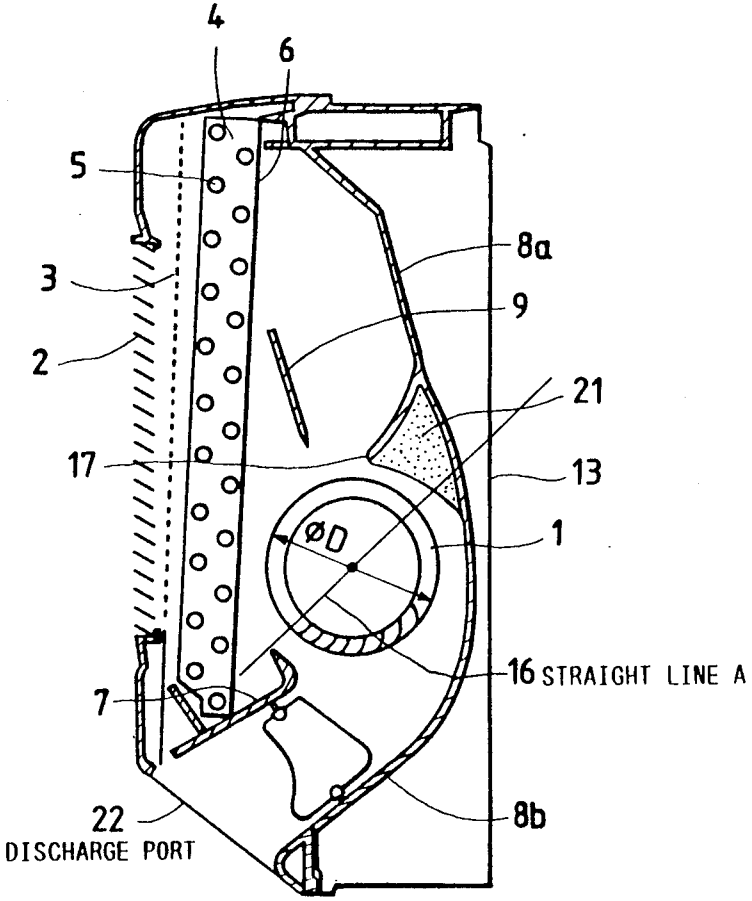

In the embodiment of FIG. 19, a sound absorbing material 21 is stuck on that side of a back nose 17 which confronts a cylindrical bladed rotor 1. Thus, surging can be prevented, and the magnitude of sounds to be emitted from a discharge port 22 can be reduced during a steady operation, so that an air conditioner can be silenced.

Figure 20:
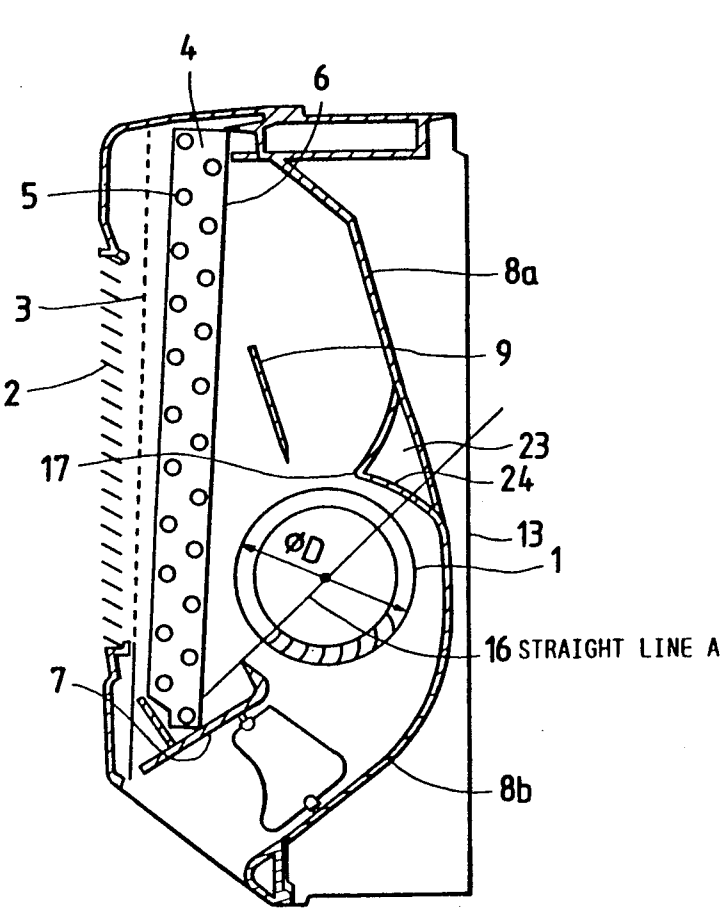

The embodiment of FIG. 20 consists in constructing a resonance type silencer in such a way that a resonance box 23 is formed on the side of a back nose 17 adjoining a cylindrical bladed rotor 1, and that the plane of the back nose 17 is formed of a plate 24 having holes or slits. The effects of this embodiment are the same as those of the embodiment shown in FIG. 19. If necessary, a sound absorbing material may be inserted in the resonance box 23.

Figure 21:
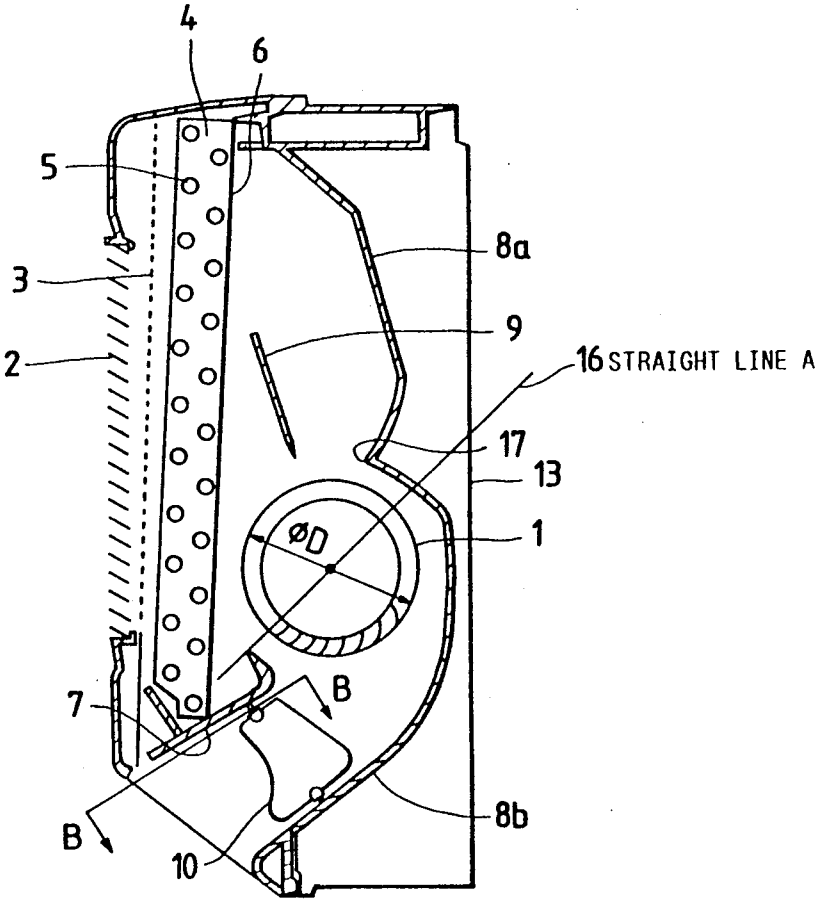
Figure 22:
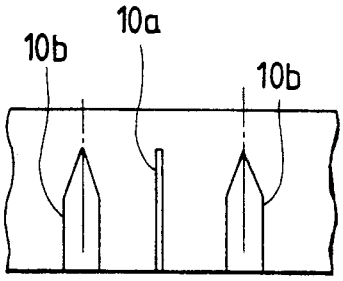
FIGS. 22 and 23 are schematic sectional views of deflectors in the embodiment of FIG. 21 taken in direction of the arrows B—B.
Figure 23:
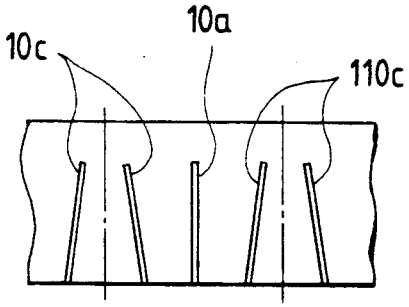

FIG. 21 shows one embodiment for preventing that flow separation within a deceleration casing which forms one factor for the occurrence of surging as stated before. Stabilizers 9 and a back nose 17 are provided on a suction side above a straight line A, and a deflector 10 which is mounted in a passage defined by a tongue 7 as well as the deceleration casing 8*b* is thickened more toward downstream as shown in FIG. 22. Alternatively, an abruptly expanding deflector (10*c*) in which a passage abruptly expanded toward the downstream is formed by two deflectors is constructed as shown in FIG. 23. Both the measures are effective as stated below. Since no fluid flows from this portion, the passage at a discharge port is not abruptly expanded, and partial abrupt deceleration in the casing usually constituting a deceleration passage is avoided, whereby the growth of any unstable disturbance ascribable to the deceleration can be suppressed, and the burble as well as the surging can be prevented. The open angle of the abruptly expanding deflector toward the lower streams should preferably be set at 7° or above. Besides, this deflector may well extend partly in the height direction of the discharge port. It is especially effective to mount the deflector in a place of low flow velocity along the casing 8*b*.

What is claimed is:

1. An air blower employing a cross-flow fan comprising a passage defined by a casing and side plates, the cross flow fan being rotatably supported by said side plates and said passage, a drive means for driving and rotating said cross-flow fan, pressure drop means including a heat exchanger disposed in a suction section of said passage, and stabilizer each having a length L meeting $L \leqq 2.5$ D, where D equals an outside diameter of a cylindrical bladed rotor of said cross-flow fan, and wherein each of said stabilizers is mounted on a suction side of said passage so as to extend from a corresponding side plate toward a central part of said cross-flow fan.

2. An air blower according to claim 1, wherein each of said stabilizers is directed toward a position between an axis of said cross-flow fan and a center of a vortex formed by said cross-flow fan.

3. An air blower according to claim 1, wherein a trailing edge of each of said stabilizers is formed with notches.

4. An air blower employing a cross-flow fan comprising a passage defined by a casing and side plates, the cross-flow fan being rotatably supported by said side plates in said passage, a driver means for driving and rotating said cross-flow fan, said pressure drop means including a heat exchanger disposed in a suction section of said passage, said casing having, on a discharge side of said passage, a shape which is expressed by:

$$\gamma = r_o \chi e^{\phi \cdot \tan\alpha},$$

where:

$\alpha a \leqq 16°$;

$r_o$ = a radius of a cylindrical bladed rotor of said cross-flow fan;

$\phi$ = an angle defined to a helix initiating position of said casing;

$\alpha$ = a spread angle of said casing; and $\gamma$ = a distance from a center of said cylindrical bladed rotor, and wherein stabilizers are mounted on the suction side of said passage so as to extend from a corresponding side plate toward a central part of said cross flow fan within a range of:

$$L/D \leqq 2.5,$$

where:

L = a length of each of said stabilizers, and

D = an outside diameter of said cylindrical bladed rotor of said cross-flow fan.

5. An air conditioner having a passage defined by a casing and side plates; a grille, a filter and a heater exchanger disposed in a suction section of the passage; a tongue means mounted under the heat exchanger for collecting drain; a cross-flow fan mounted in opposition to the tongue means; a driver means for driving and rotating the cross-flow fan; stabilizers each having a length L within a range of $L \leqq 2.5$ D, where D=an outside diameter of a cylindrical bladed rotor of said cross-flow fan, said stabilizers protruding on a section side of said passage so as to extend from a corresponding side plate toward a central part of said cross-flow fan.

6. An air conditioner according to claim 5, wherein said each stabilizer is mounted so as to be directed toward a position between an axis of said cross-flow fan and a center of a vortex formed near said tongue.

7. An air conditioner according to claim 6, wherein an air cleaning element is mounted in the suction passage over substantially an entire, or partial surface thereof.

8. An air conditioner according to claim 5, wherein a back nose protruded onto a passage side of said casing is formed on the suction side with respect to a line which connects a suction side tip of said tongue and an axis of said cylindrical bladed rotor.

9. An air conditioner according to claim 8, wherein said back nose has a tip located within an angular extend of 20° to 50° with reference to said line which connects the suction side tip of said tongue and the axis of said cylindrical bladed rotor.

10. An air conditioner according to claim 8, wherein a sound absorbing material is mounted on that side of said back nose which confronts said cylindrical bladed rotor, or said back nose is constructed into a resonance type silencer structure.

11. An air conditioner according to claim 8, wherein a plurality of deflectors are disposed downstream of said cross-flow fan, and wherein said deflectors form passages which are expanded toward lower streams of air.

12. An air conditioner according to claim 8, further comprising a plurality of deflectors disposed downstream of said cross-flow fan, and an air beam flap means for closing part of passages of air discharged to said deflectors.

* * * * *